United States Patent [19]

Watson

[11] 3,987,601

[45] Oct. 26, 1976

[54] METHOD FOR COVERING A BOOK WITH A SINGLE SHEET

[75] Inventor: Donald W. Watson, Arlington Heights, Ill.

[73] Assignee: Xerox Corporation, Stamford, Conn.

[22] Filed: May 19, 1975

[21] Appl. No.: 578,850

[52] U.S. Cl. ..... 53/3

[51] Int. Cl.[2] ..... B65B 13/02

[58] Field of Search ..... 53/3, 196, 199, 214; 281/3 R, 18, 21 R, 34; 206/424; 156/213, 477 B; 229/92

[56] References Cited

UNITED STATES PATENTS

| | | | |
|---|---|---|---|
| 480,582 | 8/1892 | Hardy | 281/18 |
| 576,236 | 2/1897 | Sues | 281/18 |
| 1,244,886 | 10/1917 | Niver | 281/18 |
| 3,380,644 | 4/1968 | D'Alessio | 206/424 X |
| 3,788,921 | 1/1974 | Polit et al. | 281/21 R X |

*Primary Examiner*—Travis S. McGehee
*Assistant Examiner*—John Sipos

[57] ABSTRACT

A method for manufacturing a covered book comprises the steps of: (a) aligning a stack of sheets to provide an edge surface; (b) fixing a protective sheet to an area, adjacent said edge surface, on the first sheet of the stack; (c) fixing an adhesive binding strip to the sheets along said edge surface, to the protective sheet, and to the last sheet of the stack; (d) wrapping the protective sheet around the edge of the stack opposite said edge surface and around the outside of the binding strip; and (e) fixing the protective sheet onto itself.

5 Claims, 3 Drawing Figures

METHOD FOR COVERING A BOOK WITH A SINGLE SHEET

The subject invention generally relates to methods for making books having protective covers and, in particular, to a method whereby a book is integrally manufactured with a removable protective cover. It should be noted that a book, disclosed hereinafter, manufactured with the subject method is the subject matter of a U.S. application contemporaneously filed herewith.

In business offices multi-page reports are frequently bound with adhesive strips to provide books for local and distant distribution. To keep the books closed during distribution the books are often placed in envelopes or have a band individually placed around them. While bands facilitate handling of books during a distribution process they are not useful when books contain sensitive subject matter because bands may be slipped into association and disassociation with a book without detection. Similarly, when envelopes are used for distributing or mailing books, books may be removed from the envelopes, may be read, and may be reinserted in suitably addressed and similar envelopes.

Books having covers which physically protect and maintain security with regard to the subject matter printed within the book and methods for making the book are known. For example, U.S. patent application Ser. No. 562,623, now U.S. Pat. No. 3,940,904, filed for "A Method For Making a Covered Book" by J. V. McGuire and R. L. Mitchell, discloses a method for making a book which comprises the steps of: aligning a stack of sheets to provide an edge surface; locating a first kraft paper sheet adjacent the first sheet of the stack; locating a second kraft paper sheet adjacent the last sheet of the stack; fixing an adhesive binding strip to the sheets along said edge surface and to the outside of the protective sheets; and fixing the first protective sheet to the second protective sheet with an adhesive. Each of the protective sheets is scored to permit removal of at least part of the protective cover when it is no longer required. However, it should be noted that two different protective sheets are required and that when the protective covers are removed the adhesive strip provides undesirable flaps because the protective sheets are not fixed directly to the front and back covers.

It is an object of the present invention to provide a method for making mailable books having integrally associated single sheet protective covers.

Briefly, the invention herein provides a method for manufacturing a covered book. The method comprises the steps of: (a) aligning a stack of sheets to provide an edge surface; (b) fixing a protective sheet to an area, adjacent said edge surface, on the first sheet of the stack; (c) fixing an adhesive binding strip to the sheets along said edge surface, to the protective sheet and to the last sheet of the stack; (d) wrapping the protective sheet around the edge of the stack opposite said edge surface and around the outside of the binding strip; and (e) fixing the protective sheet onto itself.

Additional objects and features of the invention will become apparent by reference to the following description in conjunction with the accompanying drawings, in which.

Figure 1:
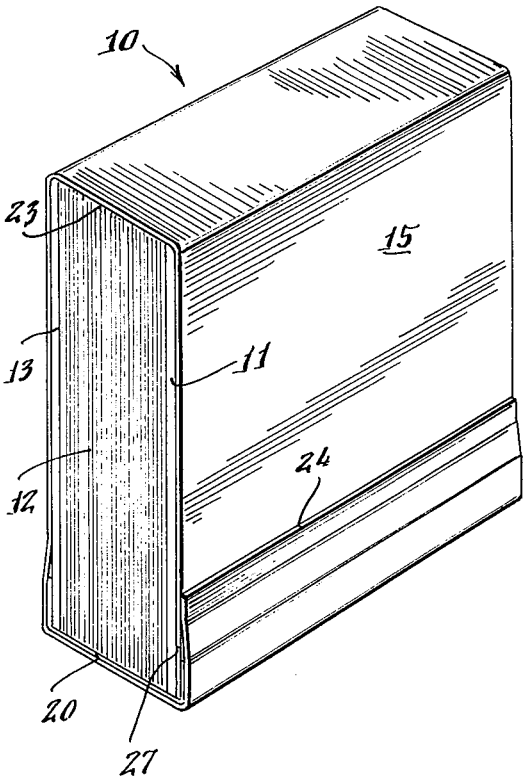
FIG. 1 is a perspective view of a book manufactured according to the invention.
Figure 2:
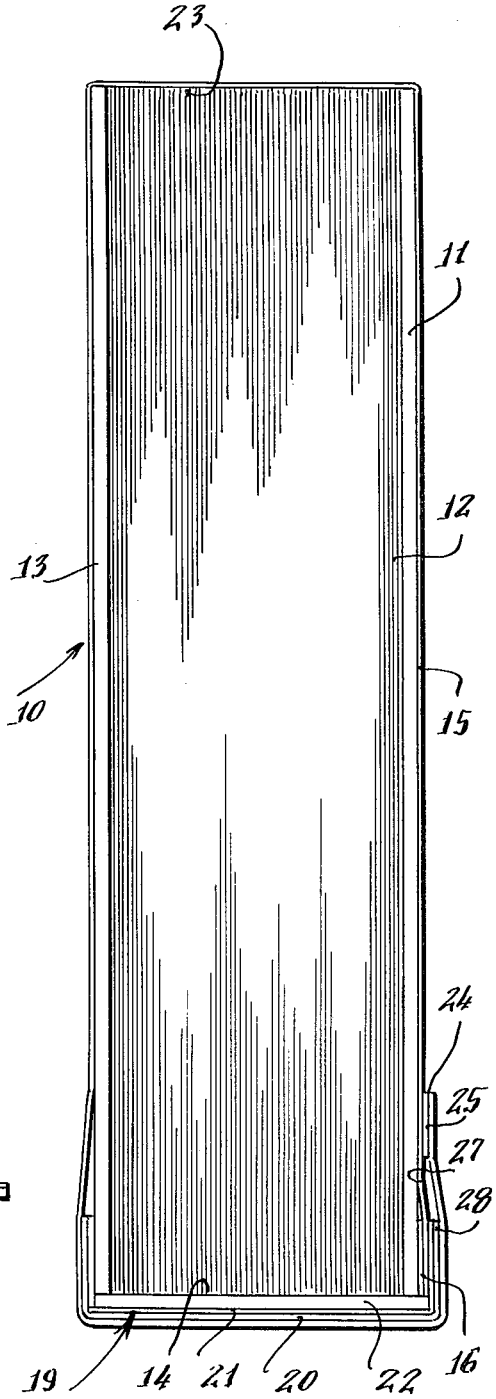
FIG. 2 is a plan view of an end of the book shown in FIG. 1.

Referring to FIGS. 1 and 2, a covered book 10, manufactured according to the invention, includes a rectangular stack of aligned sheets 11–13 providing an edge surface 14. Adjacent the first sheet 11 of the stack there is located a rectangular protective sheet 15, sheet 15 being fixed to the sheet 11, adjacent edge 14, with, for example, a longitudinal strip of pressure sensitive adhesive 16. The stack of sheets 11–13 and the protective sheet 15 are mutually coupled by an adhesive strip 19. Protective sheet 15 extends snugly around the unbound edge 23 of the stack of sheets, around adhesive strip 19, and is fixed to itself, near its end 24, by a longitudinal strip of adhesive 25. Adhesive 25 may be of the pressure sensitive type and, preferably should have a holding strength sufficient to prevent separation unless detectable tearing of sheet 15 occurs.

Figure 3:
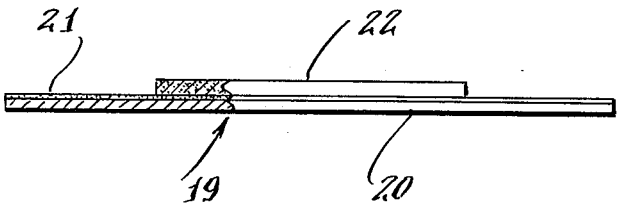
FIG. 3 is a plan view of an end of the adhesive bearing strip, used in making the book, shown in FIGS. 1 and 2, a section of the strip having been removed to more fully disclose components of the strip.

As disclosed in FIG. 3, adhesive strip 19 comprises a formable substrate 20 of, typically, relatively heavy paper stock, and adhesive coatings 21 and 22. Adhesive coatings 21 and 22 constitute a plurality of strip-like formations comprising two heat activated adhesive types. Heat activated adhesive may be either of the low or high tack types. A low tack adhesive comprises an adhesive material which when heated becomes fairly molten or fluid, thereby providing a high degree of surface wet-out with a minimum application of pressure or heat. A typical low tack adhesive may be a mixture of about 80% by weight of an ethylene/vinyl acetate copolymer having a 90% ratio of ethylene to vinyl acetate and about 20% by weight of rosin acid ester. A high tack adhesive comprises an adhesive material which when heated remains highly viscous and somewhat immobile so that a definite amount of heat is necessary to wet-out a surface being adhered. A typical high tack adhesive may be a mixture of polyethylene, a rosin acid, and a metal salt of a carboxylic acid, present in weight proportions of 80/10/10, respectively. High tack adhesives have the advantage that, on application of heat and pressure, the bond created thereby immediately possesses a high degree of strength. On the other hand, the low tack adhesive flows readily or is wicked into the edges of paper sheets to be bound. The strip 19 preferably has the high tack adhesive 21 uniformly applied to the substrate 20 while the low tack adhesive 22 is applied along the center line of the substrate with a relatively greater thickness than that of the high tack material. Typically, the width of the adhesive 22 is approximately equal to or slightly greater than the overall thickness of the stack of sheets 11. Although adhesive bearing strips having a different construction may be used, the strip 19 described is preferred because the low tack adhesive provides an excellent bond with sheets 12 and the high tack adhesive does not tend to flow onto sheets 11 and 13 when the strip is applied.

Sheet 15 is scored with a linear series of slits 27 spaced from and parallel to the end 28 of adhesive strip 19. Therefore, when the cover is no longer required a substantial part thereof may be removed. Since sheets 11 and 13 will serve as covers when the protective sheet is removed it is preferred that they be manufactured from stock which is thicker and more durable than the sheets 12.

It should be noted that sheet 15 may be manufactured from sheets of kraft paper to one side of which transfer type pressure adhesives may be applied on a mass production basis. Slits 27 may also be supplied on a mass production basis. Therefore, sheets 15 may be manufactured inexpensively.

The book 10, described above, may be manufactured in several steps. For example, one can fix sheet 15 to sheet 11 with adhesive 16. Thereafter, sheets 11–13 may be aligned to provide edge surface 14, care being taken to keep sheet 15 on the outside. The alignment may be accomplished by jogging the sheets 11–13 against a flat surface. Once the sheets are aligned the adhesive strip may be applied to the sheets 13, edge 14, and sheet 15. The application of the adhesive strip, with heat and pressure, is best accomplished with a commercial bookbinding machine such as is available from Cheshire, a Xerox Company, under the trademark 750. Said machine is disclosed in pending U.S. patent application Ser. No. 474,840, filed May 30, 1974 by R. Kuhns. In the interest of providing a concise specification the fixing operation provided by the Kuhns application has not been set forth. However, it should be considered to be incorporated herein by the above reference. The binding step sheet 15 may be wrapped around the end 23 of the book, around the bound end of the book, over slit 27, and may be fixed to itself with adhesive 25.

It is noted that binding strips and applicators other than those described above may be used to provide covered books according to the invention. In view of this and the fact that other modifications which do not deviate from the spirit of the invention will be readily apparent to those skilled in the art, it is to be understood that the description set forth above of a preferred method for making a covered book has been set forth as an example thereof and is not to be construed or interpreted as a limitation on the claims which follow and define the invention.

What is claimed is:

1. A method for manufacturing a book having a security cover, comprising the steps of:

a. aligning a stack of sheets to provide an edge surface;

b. fixing a protective sheet to an area, adjacent said edge surface, on the first sheet of the stack;

c. fixing an adhesive binding strip to the sheets along said edge surface, to the protective sheet and to the last sheet of the stack;

d. wrapping the protective sheet around the edge of the stack opposite said edge surface and around the outside of the binding strip; and e. fixing the protective sheet onto itself.

2. A method as defined in claim 1 wherein said protective sheet is scored before being located and the adhesive strip is not fixed to the scored part of the protective sheet.

3. A method as defined in claim 2 wherein said protective sheet is fixed onto itself with a pressure sensitive adhesive.

4. A method as defined in claim 3 wherein the first and last sheets of the stack are thicker than the other sheets in the stack.

5. A method as defined in claim 3 wherein said protective sheet is manufactured from kraft paper.

* * * * *